US005546978A

United States Patent [19]

Parker

[11] Patent Number: 5,546,978

[45] Date of Patent: Aug. 20, 1996

[54] REPLACEMENT FAUCET SPAYER HOSE INSTALLATION KIT

[75] Inventor: Thomas W. Parker, San Diego, Calif.

[73] Assignee: Plumbmaster, Inc., Oceanside, Calif.

[21] Appl. No.: 263,554

[22] Filed: Jun. 22, 1994

[51] Int. Cl.[6] ..... F16K 43/00; F16L 33/00

[52] U.S. Cl. ..... 137/315; 137/360; 137/798; 137/801; 251/148; 285/12

[58] Field of Search ..... 137/15, 315, 798, 137/799, 801, 360; 251/148; 285/8, 12, 149, 177; 4/443, 448

[56] References Cited

U.S. PATENT DOCUMENTS

| | | | |
|---|---|---|---|
| 1,676,036 | 7/1928 | Levitt | 285/12 |
| 3,184,256 | 5/1965 | Zavertnik | 285/12 |
| 3,381,982 | 5/1968 | Elek | 285/177 |
| 4,162,092 | 7/1979 | Hayes | 285/177 |
| 4,589,688 | 5/1986 | Johnson | 285/12 |
| 4,660,860 | 4/1987 | Todd | 285/12 |
| 5,009,247 | 4/1991 | Oberdorfer | 137/801 |
| 5,024,419 | 6/1991 | Mulvey | 251/148 |
| 5,060,689 | 10/1991 | Csaszar et al. | 251/148 |
| 5,165,727 | 11/1992 | Valley | 285/12 |
| 5,334,064 | 8/1994 | Ketterman et al. | 285/12 |
| 5,375,887 | 12/1994 | Johnson | 285/12 |

OTHER PUBLICATIONS

Front page of a 1992 Price Pfister, Inc. Wholesale Products Catalog.

Grohe America Ladylux Pull–Out Spray Kitchen Faucets Brochure (undated).

Grohe America EuroPlus Kitchen Faucets With Pull–Out Spray Head Brochure (undated).

*Primary Examiner*—George L. Walton

*Attorney, Agent, or Firm*—Ross, Clapp, Korn & Montgomery, L.L.P.

[57] ABSTRACT

A replacement faucet sprayer hose installation kit containing a hose segment having predetermined standard male and female fittings permanently attached to the opposite ends thereof, and a plurality of male and female adaptor fittings adapted to selectively interconnect the male and female hose fittings to the water outlet line of a faucet and to a pull-out faucet spray head.

9 Claims, 2 Drawing Sheets

REPLACEMENT FAUCET SPAYER HOSE INSTALLATION KIT

BACKGROUND OF THE INVENTION

1. Field of the Invention

This invention relates to faucet sprayer hoses, and more particularly to an aftermarket product for use with kitchen and lavatory faucets having a pull-out spray head.

2. Description of Related Art

The design and use of faucets having pull-out sprayer hoses is well known. In recent years, the installation and use of kitchen and lavatory or bathroom faucets with pull-out spray heads has also become more widespread. Such faucets are made by several foreign and domestic OEM manufacturers, and utilize differing hardware for connecting the spray heads to their respective water supply lines. Because of the different types of fittings used by the various manufacturers, the suppliers of aftermarket products such as replacement hoses for pull-out faucets have previously had to stock connecting hoses fabricated with each different type of fitting. A faucet sprayer hose installation kit is therefore needed that will facilitate the use of a single prefabricated replacement hose with any known conventional faucet having a pull-out spray head.

SUMMARY OF THE INVENTION

According to the present invention, a replacement faucet sprayer hose installation kit is provided that comprises a hose segment having predetermined standard male and female fittings permanently attached to the opposite ends thereof, and a plurality of male and female adaptor fittings adapted to selectively interconnect the male and female hose fittings to the faucet outlet port of a faucet and to a faucet spray head.

According to one embodiment of the invention, a replacement faucet sprayer hose installation kit is provided that preferably comprises a hose segment further comprising an elongated, flexible, tubular polymeric conduit surrounded by corrugated stainless steel shielding, having preselected standard male and female connectors respectively attached to the opposite ends thereof; at least one fitting adapted for use in releasably interconnecting the male connector of the hose to a faucet spray head; and at least one fitting adapted for use in releasably interconnecting the female connector of the hose to the water outlet port of a faucet.

According to another embodiment of the invention, a replacement faucet sprayer hose installation kit is provided that preferably comprises a hose segment further comprising an elongated, flexible, tubular polymeric conduit surrounded by corrugated stainless steel shielding, having preselected standard male and female connectors respectively attached to the opposite ends thereof; at least one fitting adapted for use in releasably interconnecting the female connector of the hose to a faucet spray head; and at least one fitting adapted for use in releasably interconnecting the male connector of the hose to the water outlet port of a faucet.

According to another embodiment of the invention, a replacement faucet sprayer hose installation kit is provided that preferably comprises a hose segment further comprising an elongated, flexible, tubular polymeric conduit surrounded by corrugated stainless steel shielding, having preselected standard male and female connectors respectively attached to the opposite ends thereof; at least one fitting adapted for use in releasably interconnecting the male connector of the hose to a faucet spray head having a connector not directly attachable to the preselected standard male connector; and at least one fitting adapted for use in releasably interconnecting the female connector of the hose to the water outlet port of a faucet having a connector not directly attachable to the preselected standard female connector.

According to another embodiment of the invention, a replacement faucet sprayer hose installation kit is provided that preferably comprises a hose segment further comprising an elongated, flexible, tubular polymeric conduit surrounded by corrugated stainless steel shielding, having preselected standard male and female connectors respectively attached to the opposite ends thereof; at least one fitting adapted for use in releasably interconnecting the female connector of the hose to a faucet spray head having a connector not directly attachable to the preselected standard female connector; and at least one fitting adapted for use in releasably interconnecting the male connector of the hose to the water outlet port of a faucet having a connector not directly attachable to the preselected standard male connector.

According to another embodiment of the invention, an aftermarket replacement sprayer hose installation kit is provided for OEM faucets equipped with means for receiving hot and cold water from external supply lines, a mixing valve operable to combine the hot and cold water in the proportions needed to adjust the temperature of the water as desired, faucet outlet means for conveying the temperature-adjusted water through the housing from the mixing valve to a flexible sprayer hose, a first connector that connects the faucet outlet port to a flexible sprayer hose, and a second connector that connects the flexible sprayer hose to a pull-out spray head, the subject kit comprising: A replacement hose segment having a preselected standard male connector attached to one end thereof and a preselected standard female connector attached to the opposite end thereof; and a plurality of fittings adapted for selective use in releasably interconnecting the standard male and female connectors of the hose to the first and second connectors of the faucet, where the first and second connectors are nonstandard connectors.

BRIEF DESCRIPTION OF THE DRAWINGS

The apparatus of the invention is further described and explained in relation to the following figures of the drawings wherein.

Like reference numerals are used to indicate like parts in all figures of the drawings.

DESCRIPTION OF THE PREFERRED EMBODIMENTS

Figure 1:
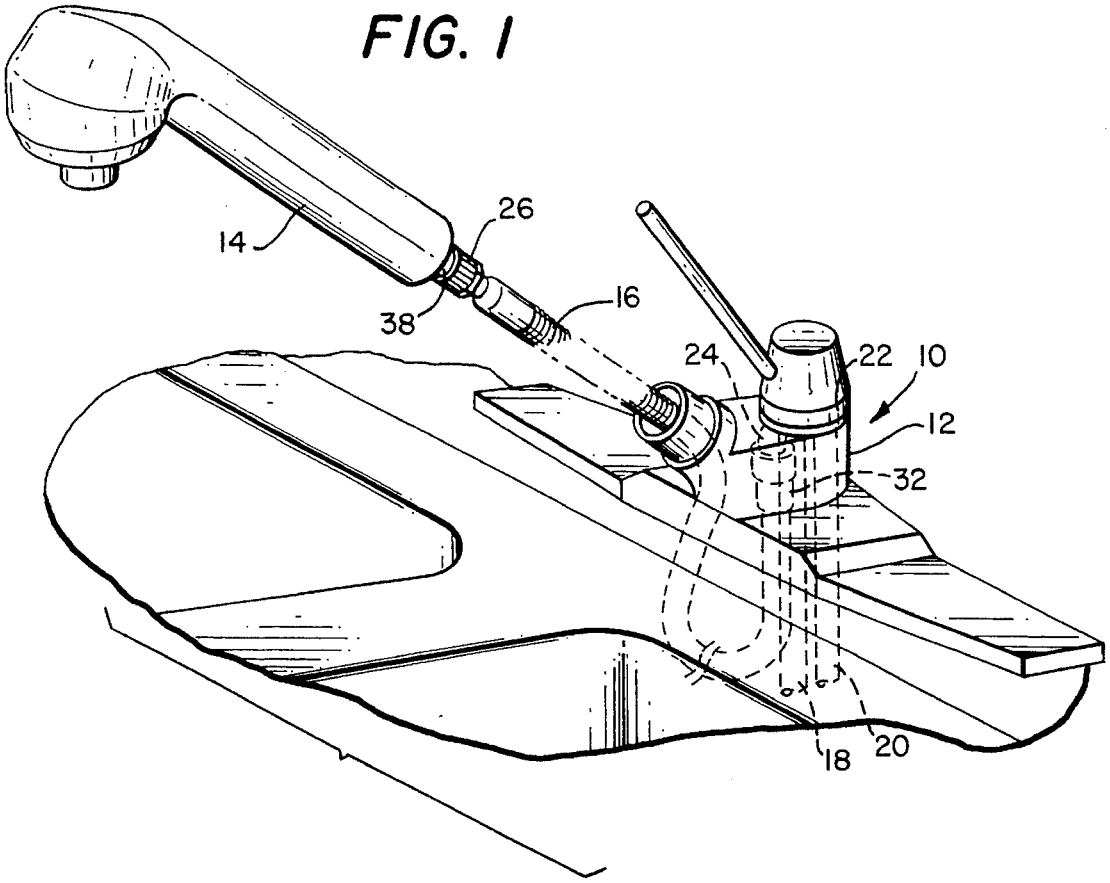
FIG. 1 is a simplified perspective view, partially broken away, of a faucet installation, depicting the use of a flexible hose for attaching a pull-out spray head.

Referring to FIG. 1, faucet unit 10 preferably comprises housing 12, pull-out spray head 14, and flexible connector hose 16. In a conventional hot and cold water installation, faucet unit 10 receives water through hot and cold water supply lines 18, 20 from an external source and directs the hot and cold water through valve 22. Valve 22 is typically manually operated, and most generally mixes hot and cold water in the desired proportions and adjusts the total flow to a desired level. After passing through valve 22, the temperature-adjusted water is conveyed through a water outlet port either inside or under housing 12 that is defined in FIG. 1 by a first connector 24 to which hose 16 is connected. In an installation where only cold ("tap") water is supplied to faucet unit 10, it will be apparent that the mixing function is not performed by valve 22, and cold water alone is accordingly conveyed through housing 12 to first connector 24.

Figure 2:
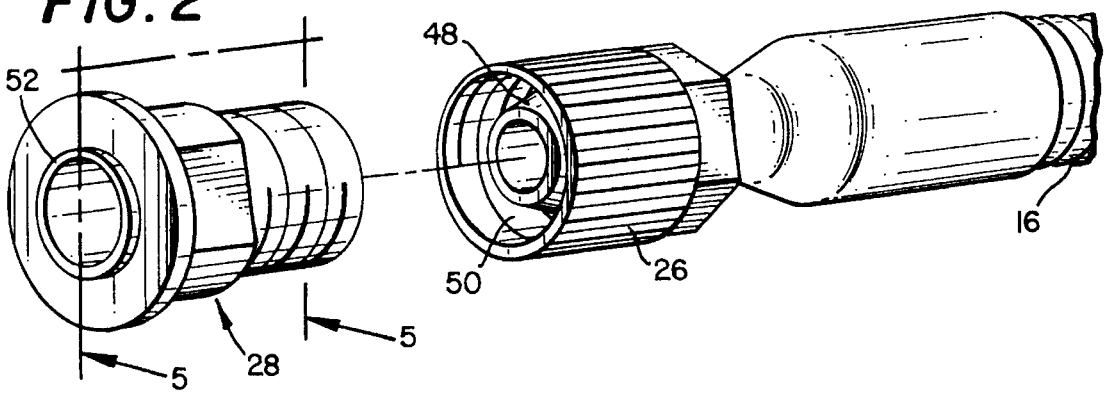
FIG. 2 is an exploded format perspective view showing a standard female connector on one end of a replacement hose and a preferred adaptor for use in connecting the female end of the hose to a nonstandard faucet or spray head connector.
Figure 3:
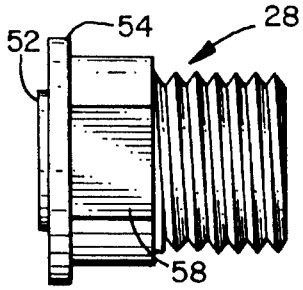
FIG. 3 is a side elevation view of the adaptor shown in FIG. 2.
Figure 4:
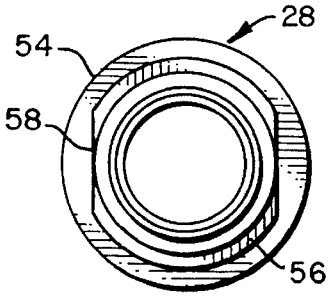
FIG. 4 is a rear elevation view of the adaptor shown in FIGS. 2 and 3.

Hose 16 preferably comprises an elongated, flexible, tubular polymeric conduit surrounded by corrugated stainless steel shielding. It will be appreciated upon reading this disclosure, however, that other types of hose construction such as, for example, fiber reinforced polymeric hoses and the like can be substituted for the preferred hose 16 in the replacement faucet sprayer hose installation kit of the invention. As shown in FIG. 1, hose 16 has preselected standard male connector 32 and female connector 26 (more visible in FIGS. 9 and 2, respectively) attached to its opposite ends.

For purposes of the present invention, hose 16 can be made up with any of the available OEM-type male and female faucet connectors already attached to opposite ends of the hose as the "preselected standard" male and female connectors. According to the embodiment shown in FIGS. 1, 2 and 9, applicant has chosen connectors like the Delta® brand faucet connectors for use as the preselected standard male and female connectors 32 and 26, respectively, because of the widespread use of such faucets. When the replacement faucet sprayer hose installation kit of the invention (with hose 16 having Delta®-type connectors as the preselected standard male and female connectors) is used with a Delta® brand faucet unit, no other adaptors are required for installation, and the replacement hose segment can be attached directly to the water outlet port connector 24 of faucet unit 10 and to inlet end 38 of spray head 14.

The replacement faucet sprayer hose installation kit of the invention preferably also comprises a plurality of adaptors that make hose 16 adaptable for use with brands of faucet units having connectors other than those on the Delta® brand faucets (or their structural equivalents, such as Peerless® brand faucets). Other well-known faucet brands include, for example, Kohler, Grohe, KWC, Price Pfister, Euro-Style, Moen, American Standyne, Sterling, and the like. Applicant has developed four adaptors that are each attachable to the preselected Delta® type connectors, and that when used in various combinations, permit the attachment of hose 16 to any of the above-mentioned brands of faucet units presently known that are characterized by pull-out spray heads.

Referring to FIGS. 2–5, adaptor 28 is designed for use in attaching the preselected female standard connector 26 of hose 16 to one of either the faucet or sprayer head of Kohler, KWC, Euro-Style, Moen, American Standyne or Sterling brand faucet units having pull-out spray heads. (It should be noted that in some brands, the spray head is adapted for connection to the end of the hose having the female connector and the water outlet port of the faucet is adapted for connection to the end of the hose having the male connector, while in other brands, the male and female connectors are reversed.)

Figure 5:
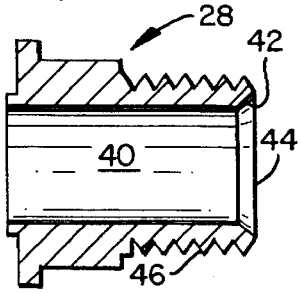
FIG. 5 is a cross-sectional view taken along line 5—5 of FIG. 2.

As shown in FIG. 5, adaptor 28 is preferably made of chrome-plated brass. Adaptor 28 preferably comprises a constant 0.330" inside diameter, longitudinal bore section 40 with a chamfer 42 that flares outwardly at an angle of about 30° near the threaded end 44 to facilitate engagement with the cooperating, inwardly tapered surface 48 (FIG. 2) of connector 26. Threads 46 of adaptor 28 are preferably ¼–18 IPS compression with a 0.520" major diameter. The unthreaded outer section of adaptor 28 (FIGS. 2–5) preferably comprises annular boss 52 having a width of from about 0.020" to about 0.030" and an outside diameter of 0.390", flange 54 having a width of 0.060" and an outside diameter of between 0.700" and 0.710", and body section 56 having a width of about 0.250" and an outside diameter of about 0.600" with a pair of opposed 17/32" flats 58.

Figure 6:
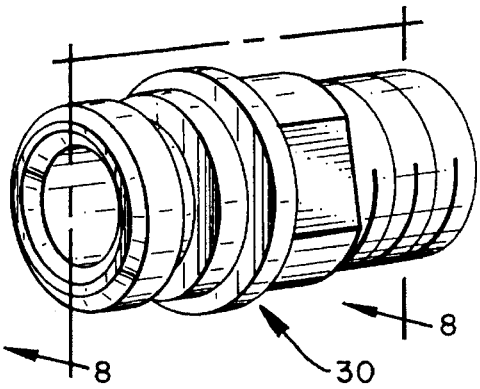
FIG. 6 is a perspective view showing another preferred adaptor for use in connecting the female end of the hose to a nonstandard faucet or spray head connector.
Figure 7:
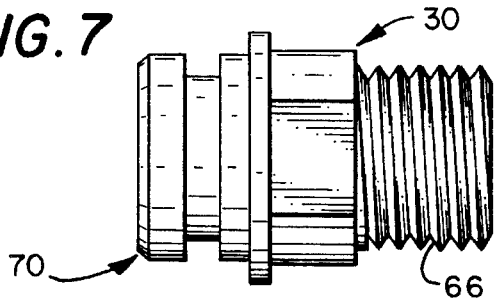
FIG. 7 is a side elevation view of the adaptor shown in FIG. 6.
Figure 8:
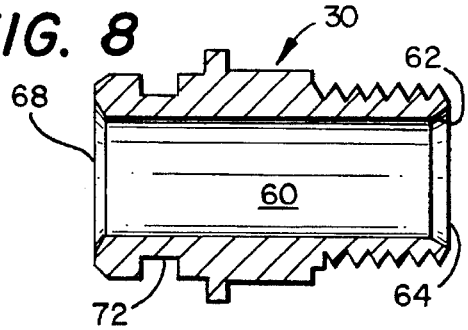
FIG. 8 is a cross-sectional view taken along line 8—8 of FIG. 6.

Referring to FIGS. 6–8, adaptor 30 is designed for use in attaching the preselected female standard connector 26 of hose 16 to one of either the Grohe or Price Pfister brand faucet units having pull-out spray heads. Adaptor 30 is preferably made of chrome-plated brass. Adaptor 30 preferably comprises a constant 0.330" inside diameter, longitudinal bore section 60 with a chamfer 62 that flares outwardly at an angle of about 30° near the threaded end 64 to facilitate engagement with the cooperating, inwardly tapered surface 48 (FIG. 2) of connector 26. Opposite end 68 is also desirably chamfered (0.080" rise; 0.030" run) inside and outside as shown. Threads 66 of adaptor 30 are preferably ¼–18 IPS compression with a 0.520" major diameter. The unthreaded outer section of adaptor 30 is preferably made as for adaptor 28 except that in place of boss 52, adaptor 30 has a forwardly extending nose 70 0.312" in width with a 0.580" outside diameter, and a 0.100" wide, 0.120" deep, recess 72 spaced 0.130" back from end 68.

Figure 9:
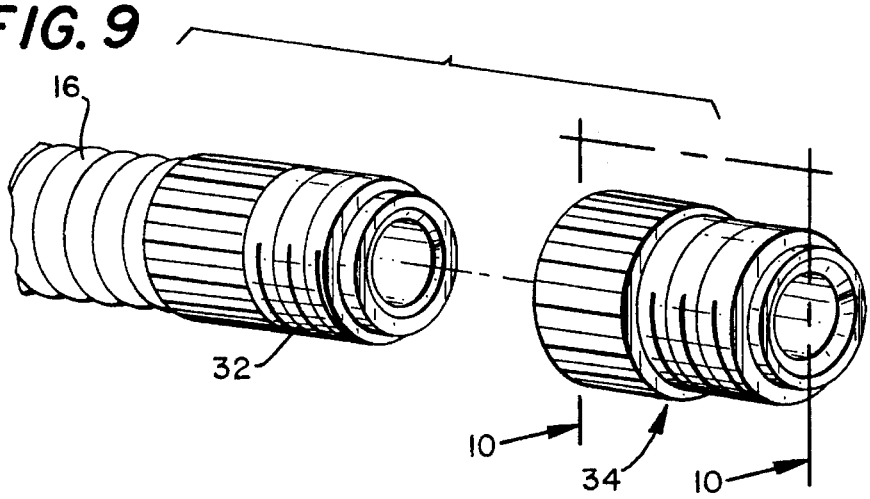
FIG. 9 is an exploded perspective view showing a standard male connector on one end of a replacement hose and a preferred adaptor for use in connecting the male end of the hose to a nonstandard faucet or spray head connector.
Figure 10:
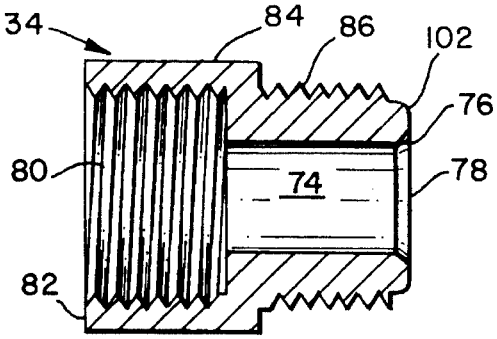
FIG. 10 is a cross-sectional view taken along line 8—8 of FIG. 9.

Referring to FIGS. 9–10, adaptor 34 is designed for use in attaching the preselected male standard connector 32 of hose 16 to one of either the KWC, Price Pfister or Euro-Style brand faucet units having pull-out spray heads. Adaptor 34 is preferably made of chrome-plated brass. Adaptor 34 preferably comprises longitudinal bore section 74 having a 0.330" inside diameter with a 1/32"×30° lead-in chamfer 76 and a 0.030" radius 102 to a 0.540" outside diameter. Outside threads 86 are preferably 18 TPI with a 0.635" major diameter, are spaced back about 0.055" from end 78, and extend to a distance of 0.430" from end 78. The unthreaded outer section 84 of adaptor 34 is preferably knurled, with a width of about 0.490" and an outside diameter of 0.750". Inside threads 80 preferably extend about 0.400" inwardly from end 82, and are preferably cut at 18 TPI with a major diameter of 0.625" to mate with the outside threads of male connector 32 of hose 16.

Figure 11:
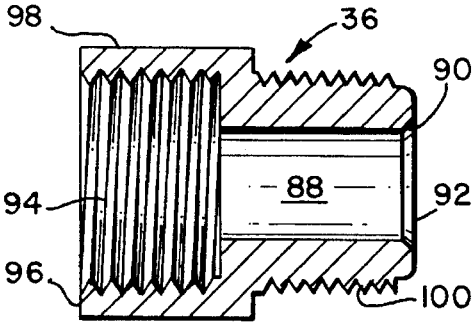
FIG. 11 is a cross-sectional view of another preferred adaptor for use in connecting the male end of a replacement hose to a nonstandard faucet or spray head connector.

Referring to FIG. 11, adaptor 36 is designed for use in attaching the preselected male standard connector 32 of hose 16 (FIG. 9) to one of either the Kohler, Grohe, Moen, American Standyne, or Sterling brand faucet units having pull-out spray heads. Adaptor 36 is preferably made of chrome-plated brass. Adaptor 36 preferably comprises longitudinal bore section 88 having a 0.330" inside diameter with a 1/32"×30° lead-in chamfer 90 and a 0.030" radius to a 0.540" outside diameter. Outside threads 100 are preferably cut at 24 TPI with a 0.575" major diameter, are spaced back about 0.055" from end 92, and extend to a distance of 0.460" from end 92. The unthreaded outer section 98 of adaptor 36 is preferably knurled, with a width of about 0.390" and an outside diameter of 0.750". Inside threads 94 preferably extend about 0.400" inwardly from end 96, and are preferably cut at 18 TPI with a major diameter of 0.625" to mate with the outside threads of male connector 32 of hose 16.

In each instance where the foregoing adaptors are used in replacing a hose having connectors other than the preselected standard connectors, the ferrule from the old hose should be removed and placed on the new hose for use with the adaptors.

Although adaptors 28, 30, 34, 36 as disclosed herein are preferred for use with preselected standard connectors 26, 32, it will become apparent that selection of different standard connectors for hose 16 will require an associated modification in the structure of the adaptors.

Other alterations and modifications of the invention will likewise become apparent to those of ordinary skill in the art upon reading the present disclosure, and it is intended that the scope of the invention disclosed herein be limited only by the broadest interpretation of the appended claims to which the inventor is legally entitled.

I claim:

1. An aftermarket replacement faucet sprayer hose installation kit for use with an OEM faucet having a mixing valve with a threaded outlet port, a pull-out spray head with a threaded inlet port, and a hose segment connecting the outlet port to the inlet port, the kit comprising:

a replacement hose segment having first and second ends, a preselected standard threaded male connector attached to said first end and a cooperating preselected standard threaded female connector attached to said second end, each of said preselected standard threaded male and female connectors being directly attachable to at least a faucet mixing valve outlet port and to a pull-out spray head inlet port of a preselected OEM faucet; and a plurality of selectively interchangable adaptors each having at least one threaded end and a generally cylindrical longitudinal bore, one threaded end of each said adaptor being directly attachable to at least one of said first and ends second end of said replacement hose segment and the other end of said adaptor being directly attachable to at least one of a mixing valve outlet port and a pull-out spray head inlet port of a different OEM faucet having a mixing valve outlet port and a pull-out spray head inlet port with fittings not directly attachable to the preselected standard threaded male connector and not directly attachable to the preselected standard threaded female connector.

2. The kit of claim 1 wherein the preselected standard threaded male and female connectors are Delta® brand-type faucet connectors.

3. The kit of claim 1 wherein at least one of said adaptors comprises an externally threaded end having ¼–18 IPS compression threads with a 0.520" major diameter, a longitudinal bore with an inside diameter of about 0.330" and a chamfer flaring outwardly at an angle of about 30° near the threaded end, an unthreaded end comprising an annular boss having a width of from about 0.020" to about 0.030" and an outside diameter of 0.390", a flange disposed behind the annular boss having a width of 0.060" and an outside diameter between 0.700" and 0.710", and a body section disposed between the flange and the externally threaded end, the body section having a width of about 0.250" and an outside diameter of about 0.600" with a pair of opposed 17/32" flats.

4. The kit of claim 1 wherein at least one of said adaptors comprises an externally threaded end having ¼–18 IPS compression threads with a 0.520" major diameter, a longitudinal bore with an inside diameter of about 0.330" and a chamfer flaring outwardly at an angle of about 30° near the threaded end; an unthreaded end section having a forwardly extending nose 0.312" wide with a 0.580" outside diameter terminating at an unthreaded end, the nose having a recess 0.1" wide and 0.120" deep spaced 0.130" from the unthreaded end, a first chamfer flaring outwardly from the longitudinal bore at the unthreaded end and a second chamfer flaring inwardly from the outside of the nose at the unthreaded end.

5. The kit of claim 1 wherein at least one of said adaptors comprises an internally threaded end having an unthreaded outside section, an externally threaded end section, and a longitudinal bore having a 0.330" inside diameter with a 1/32"×30° lead-in chamfer at the externally threaded end section and a 0.030" radius to a 0.540" outside diameter, the externally threaded end section having an end with threads cut at 18 TPI with a 0.635" major diameter terminating about 0.055" from the end; the unthreaded outside section having a width of about 0.490", a knurled outside diameter of about 0.750", and internal threads extending longitudinally inward about 0.400" from the internally threaded end, the internal threads cut at 18 TPI with a major diameter of 0.625".

6. The kit of claim 1 wherein at least one of said adaptors comprises an internally threaded end having an unthreaded outside section, an externally threaded end section, and a longitudinal bore having a 0.330" inside diameter with a 1/32"×30° lead-in chamfer at the externally threaded end section and a 0.030" radius to a 0.540" outside diameter; the externally threaded end section having an end with threads cut at 24 TPI with a 0.575" major diameter terminating about 0.055" from the end; the unthreaded outside section having a width of about 0.390", a knurled outside diameter of about 0.750", and internal threads extending longitudinally inward about 0.400" from the internally threaded end, the internal threads cut at 18 TPI with a major diameter of 0.625 ".

7. The kit of claim 1 wherein the hose segment comprises an elongated, flexible, tubular polymeric conduit.

8. The kit of claim 7 wherein the conduit is reinforced.

9. The kit of claim 8 wherein the conduit is surrounded by corrugated stainless steel shielding.

* * * * *

UNITED STATES PATENT AND TRADEMARK OFFICE

CERTIFICATE OF CORRECTION

PATENT NO. : 5,546,978

DATED : August 20, 1996

INVENTOR(S) : Thomas W. Parker

It is certified that error appears in the above-identified patent and that said Letters Patent is hereby corrected as shown below:

Column 2, line 50

Delete "format" and insert --front-- in place thereof.

Column 5, line 52

Delete "ends second end" and insert --second ends-- in place thereof.

Signed and Sealed this

Fifth Day of November, 1996

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,546,978
DATED : August 20, 1996
INVENTOR(S) : Thomas W. Parker

It is certified that error appears in the above-identified patent and that said Letters Patent is hereby corrected as shown below:

On the title page,
Change "Spayer" to --Sprayer--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 5,546,978
DATED : August 20, 1996
INVENTOR(S) : Thomas W. Parker

It is certified that error appears in the above-identified patent and that said Letters Patent is hereby corrected as shown below:

Title page,
Item [54], Title, change "SPAYER" to -- SPRAYER --.

Signed and Sealed this

Seventeenth Day of August, 2004

JON W. DUDAS
*Acting Director of the United States Patent and Trademark Office*